United States Patent [19]

Dube

[11] Patent Number: 4,865,107

[45] Date of Patent: Sep. 12, 1989

[54] DOUBLE-GLAZED WINDOW APPARATUS WITH INSULATING SHADE

[76] Inventor: Marcel Dube, P.O. Box 365, Hawkesbury, Ontario, Canada, K6A 1R1

[21] Appl. No.: 249,702

[22] Filed: Sep. 27, 1988

[30] Foreign Application Priority Data

Aug. 10, 1987 [CA] Canada ..... 548891

[51] Int. Cl.[4] ..... A47H 1/00

[52] U.S. Cl. ..... 160/85; 160/264

[58] Field of Search ..... 160/108, 237, 264, 300, 160/85, 88, 275, 276

[56] References Cited

U.S. PATENT DOCUMENTS

| | | | |
|---|---|---|---|
| 621,421 | 3/1899 | Kinnear . | |
| 687,870 | 12/1901 | Watkinson . | |
| 783,041 | 2/1905 | Hultquist | 160/264 |
| 1,153,015 | 9/1915 | Bauer | 160/300 |
| 2,349,368 | 5/1944 | Myers . | |
| 3,980,122 | 9/1976 | Takazawa | 160/85 |
| 4,194,550 | 3/1980 | Hopper | 160/121 R |

FOREIGN PATENT DOCUMENTS

| | | | |
|---|---|---|---|
| 685113 | 11/1960 | Canada | 160/264 |
| 0413456 | 9/1984 | Canada | 108/32.1 |
| 0063541 | 3/1982 | European Pat. Off. . | |
| 1268866 | 9/1960 | France . | |

*Primary Examiner*—Blair M. Johnson

*Attorney, Agent, or Firm*—Heslin & Rothenberg

[57] ABSTRACT

A double-glazed window apparatus for use at a sloped angle is disclosed having an insulating roller shade assembly extendable between the glazings in a U-shaped loop for insulating or shading. The apparatus includes supports for holding the sheet in spaced relation to the glazing and maintaining defined air spaces for insulation. A lower portion of the sheet is supported by stationary supports while an upper portion is supported by cross bars attached to the sheet and riding on slideways along both side edges thereof.

10 Claims, 2 Drawing Sheets

DOUBLE-GLAZED WINDOW APPARATUS WITH INSULATING SHADE

FIELD OF INVENTION

The present invention relates to a double-glazed window having an insulating roller shade extendable between the glazings, and in particular, to such a window for use at a sloped angle, such as in the roof of a solarium or a greenhouse, for insulating and shading against heat transmission.

BACKGROUND OF THE INVENTION

Solariums and greenhouses are often either too hot during the day or too cold at night. Low emissivity glass helps reduce the cold, but not the hot condition; darkened glass helps reduce the hot, but not the cold condition. Shades installed on the inside of a roof panel or window help reflect the visible light out, but the infrared portion is trapped inside, and further, their thermal insulating value is also marginal.

A more effective way of shading and insulating is to have a retractable reflective shade in between the pair of glazings of the roof window panel. With such an arrangement, excess solar heat is prevented from coming in and the insulating value of the window is improved. The insulating value can be further improved by having multiple shades or sheets within the window to create additional insulating air spaces. Still further improved insulating value can be obtained if the surfaces of the sheets have a low emissivity coefficient, thereby absorbing and reemitting little radiation.

U.S. Pat. No. 4,194,550 (Hopper) discloses an insulating shade apparatus mounted between the pair of glazings of a window. The shade is made of a plurality of sheets which have low emissivity surfaces and which unwind from a retracting spring roller. The sheets are kept spaced apart by various means for creating insulating air spaces. The sheets are pulled down by means of a cable or the like and are retracted by the spring inside the roller. In one embodiment, the window is used at a sloped angle, but, as pointed out, strong spring and cable tension are required to keep the sheets taut in order to keep the sheets in the spaced relation need for maintaining the air spaces between the sheets and the glazings.

Canadian Patent No. 1,174,904 (Dube) and EPO 063 541 A2 (Seska) both disclose a double thickness roller shade made of a single continuous low emissivity sheet which unwinds between a pair of glazings. The sheet unwinds from a driven shade roller; and the opposite end of the sheet is fastened at the upper end of the window frame. The weight of a tensioning roller resting freely on the sheet keeps the sheet tensioned downward in a U-shaped configuration. In combination with the pair of glazings the sheet thus defines three insulating air spaces. This arrangement is attractive for its simplicity, however, it cannnot be used for windows at a substantially sloped angle since the weight of the tensioning roller will not hold the sheet taut enough to prevent excessive sagging of the sheet and maintain the air spaces.

U.S. Pat. No. 2,349,368 (Myers) discloses a retractable roller type flexible curtain, which is capable of being used at an angle, for controlling the flow of air or gas in a duct. The curtain has a U-shaped configuration when extended, however, the object of the flexible curtain is to control gas flow and there is no attempt to maintain the legs of the U-shaped curtain separated to create air spaces when extended.

SUMMARY OF THE INVENTION

Briefly, the present invention comprises an improved window apparatus capable of shading and/or insulating against conductive, convective and radiant heat transmission and is designed for securement to a surrounding structure such as to reside at a sloped angle to horizontal. The window apparatus includes a frame structure having a top end, a bottom end, two opposing sidewalls and two glazings. The glazings are in fixed opposing relation by the frame structure's top end, bottom end and opposing side walls. An insulating shade assembly is mounted internal the frame structure between the two glazings and is operable between a retracted position and an extended position. The shade assembly includes a reflective sheet which has two ends and two side edges. The sheet is secured at one end to a driveable shade roller and at the other end to the top of the frame structure. The shade roller is itself mounted near the top end of the frame structure. The sheet assembly also includes a tensioning roller resting on the sheet between the two sheet ends. The weight of the tensioning roller provides tensioning of the sheet in a downward direction when the sheet is extended such that the sheet has a substantially U-shaped configuration when extended, with an upper portion and lower portion being defined. The window apparatus also consists of first support means affixed to the top portion of the sheet so as to extend from or retract to the shade roller with the sheet. The first support means has ends which protrude beyond the side edges of the sheet. Two slideways are secured to the frame structure on opposing sidewalls such that the first support means ends engage and ride within the slideways as the sheet is extended and retracted. The first support means are sufficiently rigid so as to maintain the upper portion of the sheet in a plane substantially parallel to the glazings when the sheet is extended.

In a preferred embodiment, two guideways are also secured to the frame structure on opposite sidwalls in a plane generally parallel to and at a spaced distance above the lower glazing. In this embodiment, the tensioning roller ends are sized and shaped to engage and ride within the guideways.

In a further enhanced embodiment, stationary support means is provided in a plane generally intermediate the plane of the guideways and the lower glazing. The stationary support means is configured to sustain the lower portion of the sheet in a plane substantially parallel to and at a spaced distance slightly above the lower glazing. In this embodiment, the first support means, stationary support means and tensioning roller cooperate to maintain the sheet in the desired U-shaped spaced relation intermediate the glazings such that three insulating air spaces are defined.

BRIEF DESCRIPTION OF THE DRAWINGS

While the specification concludes with claims particularly pointing out and distinctly claiming the present invention, the objects, features and advantages of the invention can be more readily ascertained from the following detailed description of one preferred embodiment when read in conjunction with the accompanying drawings in which:

DETAILED DESCRIPTION OF THE INVENTION

Figure 1:
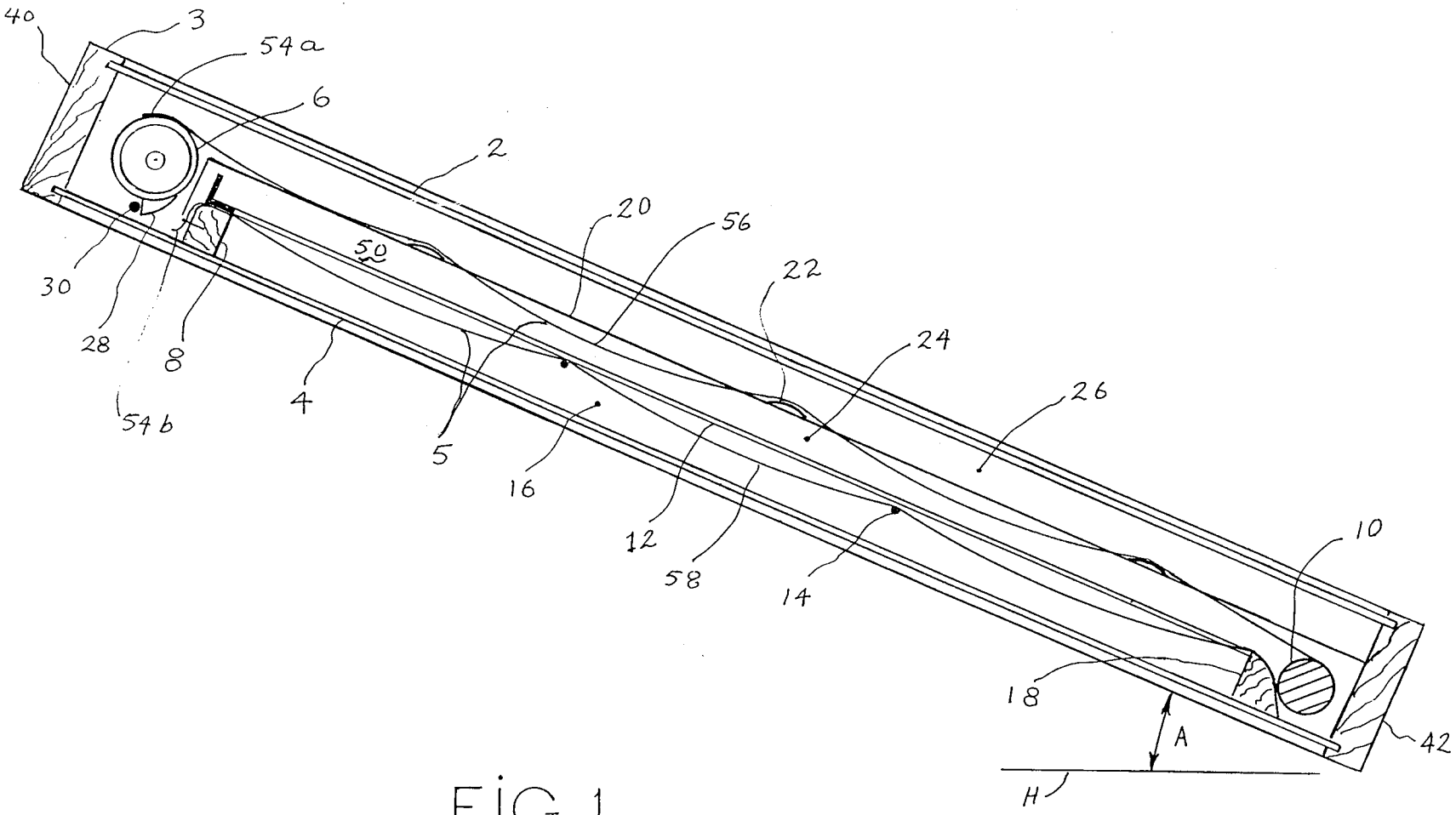
FIG. 1 is a lengthwise cross-sectional view of the window apparatus set at a sloped angle with the shade assembly in the extended position.
Figure 2:
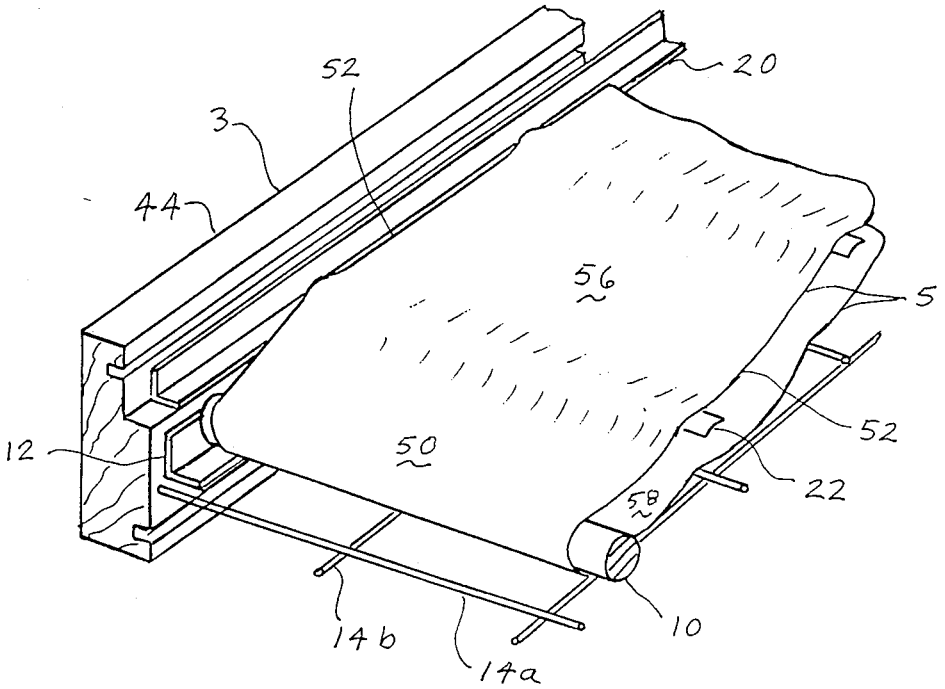
FIG. 2 is a partial perspective view of the window apparatus with the glazings removed for clarity.

FIG. 1 and FIG. 2 illustrate the preferred embodiment of the window apparatus of the present invention designed to reside at a sloped angle A to a horizontal line H. The apparatus comprises a frame structure 3 having a top end 40, a bottom end 42, and two opposing sidewalls 44 and 46. An upper glazing 2 and a lower glazing 4 are fixed in opposing substantially parallel relation by the frame structure 3.

An insulating shade assembly 50 is mounted between the two glazings 2 and 4 and includes a reflective sheet 5 having two ends 54*a* and 54*b* and two side edges 52. One end 54*a* of the sheet is secured to a drivable shade roller 6 which is mounted near the frame structure's top end 40. The other end of sheet 5 is fixedly secured by any conventional means to the frame structure also near its top end through fastening bar 8 mounted to the frame structure. The shade assembly 50 also includes a tensioning roller 10 which rests on the sheet 5 between the sheet ends for tensioning the sheet in a downward direction such that the sheet has a substantially U-shaped configuration when extended. When the shade assembly is in the extended position the upper leg of the U-shaped sheet configuration defines an upper portion 56 of the sheet and the lower leg of the U-shaped configuration defines a lower portion 58 of the sheet.

The insulating shade assembly also comprises a moveable or first support means 22 affixed to the upper portion 56 of the sheet parallel to the axis of the shade roller 6 so as to extend from and retract to the shade roller with the sheet. The first support means preferably consists of a plurality of elongate bars of a length sufficient for their ends to engage and slide on two slideways 20 when the upper portion of the sheet is being extended or retracted. Slideways 20 are secured to frame structure 3 on opposing walls 44 and 46. First support means 22 is constructed so as to support the sheet 5 in a substantially flat plane when extended. Shade roller 6 is mounted sufficiently above than the slideways for the ends of the first supporting means to land smoothly on the slideways whenever the sheet is being extended.

The tensioning roller 10 is of a length sufficient for its ends to engage and roll on guideways 12, which are also secured to the frame structure on opposing sidewalls. The guideways are in a plane generally parallel to and at a spaced distance above the lower glazing. The guideways may also support and seal the side edges of the lower portion 58 of the sheet if desired.

A second or stationary support means 14 is preferably provided and configured to support the lower portion 58 of the sheet 5 in a plane generally parallel to and at a spaced distance above the lower glazing 4. Support means 14 should be configured to allow maximum light transmission through the window. The stationary support means may be one or a plurality of wires, bars or the like spanning crosswise 14*a* or lengthwise 14*b* the window apparatus as best shown in FIG. 2. Support means 14 may be strung from opposing frame side walls 44 and 46 and/or from fastening bar 8 at the top end of the frame structure to sealing bar 18 at the bottom end, or simply lay on the lower glazing 4.

First support means 22, stationary support means 14 and the tensioning roller 10 cooperate to hold sheet 5 in the illustrated U-shaped configuration such that three insulating air spaces 16, 24 and 26 are defined between the glazings.

Some sagging of the sheet intermediate the supports may be tolerated as long as the air spaces are substantially preserved. The amount of sagging mainly depends upon the spacing of the supports, the weight of the tensioning roller relative to the weight of the sheet and the sloped angle of the window.

When some sacrifice in insulating value is acceptable, the stationary support means may be removed and the lower portion of the sheet allowed to rest directly on the lower glazing. This would result in a decrease of about 20% in the overall insulating value of the window apparatus with the shade assembly extended. Further, the guideways may also be removed and the tensioning roller allowed to be supported by the lower glazing. The ends of the tensioning roller could also have a ring like bulge so that the main portion of the tensioning roller does not abrade the sheet by pressing it against the lower glazing.

When the prime objective is shading, the reflective sheet may be suitably of a light color material or made of a more or less optically opaque film with a reflective layer. However, when thermal or radiative insulation is the main objective, the reflective layer should be at the surface of the sheet and have a low emissivity coefficient at least in the far-infared range, i.e., low absorbance and low re-emittance of infared radiation. The lower the coefficient, the better; the maximum acceptable is 0.6. Further, at least one of the two larger opposing boundary means of a defined air space must have a low emissivity coefficient. The boundary means with the low emissivity coefficient may either comprise the surface of the upper or the lower portion of the sheet, or the inner surface of the glazing facing either the upper or the lower portion of the sheet. For reasons of aesthetics, a low emissivity coating may be objectionable on the visible face of the sheet, in which case a glazing with a low emissivity could be used on the opposite face of the defined air space. The sheet may also be more or less optically translucent in the visible range to meet a desired degree of shading. The low emissivity coating is generally achieved by depositing metal atoms on the surface of a translucent plastic film by vacuum metallizing or sputtering techniques.

The metallic coating is in most cases very sensitive to abrasion and can be scratched or marred easily. The special way of this invention in which the tensioning roller lays the sheet onto the stationary support means without relative sliding motion of the sheet to the stationary support means ensures that virtually no abrasion is produced.

At less than a fully extended position, the roller shade is used mainly for shading and the thickness of the defined air spaces is less important. However, when used for insulation, sheet 5 is normally fully extended and it is more important to maintain relatively uniform air space thickness, meaning higher tension is required in sheet 5. This is not easily achieved at a shallow slope, for instance below 20 degrees. In this case it is preferred to allow tensioning roller 10 to bottom out, hanging nearly vertically, immediately past the rounded lower top edge of sealing bar 18, so that the full weight of tensioning roller 10 is used for tensioning sheet 5. In practice, it has been found that the minimum window sloped angle is about 15 degrees with materials generally used in the trade such as anodized or enameled aluminium sliding ways.

The sliding surfaces of slideways 20 should be smooth and hard enough for the coefficient of friction to be as low as economically feasible. Anodized or enameled aluminium is acceptable. First supporting means should be made of a lightweight but rigid and hard material for stiffness and a low coefficient of friction. A good candidate for this is aluminium alloy 7075 in the T6 temper. Their ends may also be coated or tipped with nylon or any similar low friction material.

Figure 4:
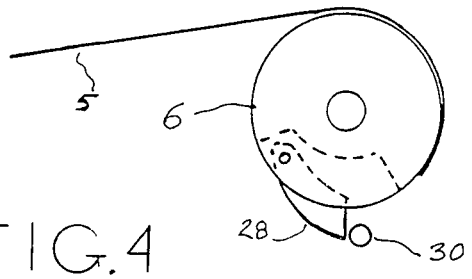
FIG. 4 is an enlarged end view of the shade roller with a stop-pawl.

In order to maintain tension in sheet 5, shade roller 6 must be stopped before tensioning roller 10 bottoms out at the bottom end of the window, this may be done in many ways known to the trade, but the preferred way, which is also a novel, is to utilize a pawl 28 (see FIG. 4). The pawl is normally held recessed in shade roller 6 by the innermost wrap of sheet 5 and extends out by means of gravity or a spring when released by the innermost wrap of sheet 5 unwinding from shade roller 6. Shade roller 6 stops when pawl 28 hits stop 30. Pawl 28 is tucked back inside shade roller 6 by sheet 5 as the innermost wrap of sheet 5 is wound back on shade roller 6. When the shade roller is driven by a motor, stop 30 may be replaced by a limit switch for stopping the motor when sheet 5 is fully extended.

As shown in FIG. 2 the upper portion of sheet 5 may be made wider than the lower portion, and of a width sufficient for its side edges to engage and rest on slideways 20 for supporting and sealing the side edges of the upper portion of the sheet when the sheet is extended.

Figure 3:
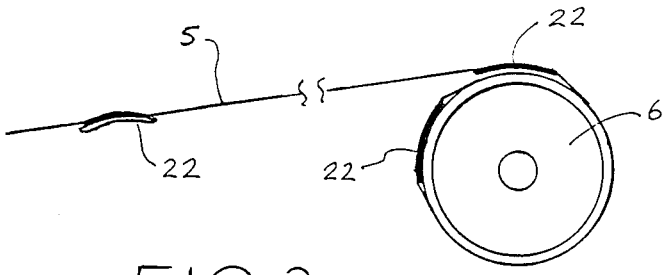
FIG. 3 is an enlarged partial end view of the shade roller and a portion of the sheet, illustrating the nesting of the first support means onto the shade roller.

FIG. 3 is an enlarged partial end view of shade roller 6 and shows the first support means 22 affixed to sheet 5 at spaced intervals. Support means 22 is shown to comprise multiple members shaped with a thin arcuate cross-section so as to conform to the shade roller and spaced so as not to overlap each other.

Although specific embodiments of the present have been described in detail above, it is to be understood that this is only for purposes of illustration. Modifications may be made to the described structures to adopt this invention to particular insulating or shading applications without departing from the scope or spirit of the attached claims.

What is claimed is:

1. An improved window apparatus capable of shading and insulating against conductive, convective and radiant heat transmission and designed for securement to a surrounding structure so as to reside at a sloped angle to horizontal, said window apparatus comprising:

a frame structure having a top end, a bottom end, two opposing sidewalls, and upper and lower glazings, said glazings being fixed in opposing, substantially parallel relation by said frame structure top end, bottom end, and opposing side walls;

an insulating shade assembly mounted internal said frame structure between said glazings, said shade assembly being operable between a retracted position and an extended position;

said shade assembly including a reflective sheet having two ends and two side edges, said sheet being secured at one of said ends to a driveable shade roller, said shade roller being mounted near said frame structure top end, the other end of said sheet being fixedly secured to the frame structure near its top end, said shade assembly also including a tensioning roller resting on said sheet between said sheet ends, said tensioning roller providing tensioning of said sheet in a downward direction, said sheet having a substantially U-shaped configuration when extended such that an upper portion and a lower portion of said sheet are defined;

a plurality of first support members affixed only to the upper portion of said sheet so as to extend from and retract to said shade roller with said sheet, said first support members each having two ends, each of said first support members having an arcuate cross-section and each being configured such that it conforms to the shape of said shade roller when said sheet is retracted; and two slideways secured to said frame structure on opposing side walls, said first support members' ends being sized and shaped to engage and ride on said slideways as said sheet is extended and retracted, said first support members being sufficiently rigid so as to maintain in cooperation with the tensioning roller the upper portion of said sheet in a plane substantially parallel said glazings when said sheet is extended, said lower portion of said sheet having a width less than the distance between said two opposed slideways such that said lower portion rests below said slideways when said sheet is extended.

2. The improved window apparatus of claim 1, wherein said first support members are affixed at spaced intervals to said sheet and extend transverse to said sheet.

3. The improved window apparatus of claim 1, further comprising:

two guideways secured to said frame structure on opposing sidewalls in a plane generally parallel to and intermediate said lower glazing and a plane defined by said slideways;

said tensioning roller having two ends of length sufficient to engage and ride within said guideways; and stationary support means in a plane intermediate the plane defined by said guideways and the plane of said lower glazing, said stationary support means being configured to support the lower portion of said sheet in a plane substantially parallel to and at a spaced distance above the lower glazing when the sheet is extended, said stationary support means being configured to allow light transmission through the window apparatus when the sheet is retracted, whereby said first support members, stationary support means and tensioning roller cooperate to maintain said sheet in said U-shaped configuration when extended such that three insulating air spaces are defined in combination with said glazings.

4. The improved window apparatus of claim 1, wherein the upper portion of said sheet has a width sufficient for the sheet's upper portion side edges to engage said slideways for supporting and sealing the side edges of said sheet upper portion when the sheet is extended.

5. The improved window apparatus of claim 4, wherein the lower portion of the sheet has a width sufficient for its side edges to engage said guideways for supporting and sealing the side edges of said sheet lower portion when the sheet is extended.

6. The improved window apparatus of claim 1, further comprising means for stopping the shade roller as the sheet attains said extended position.

7. The improved window apparatus of claim 3, wherein one of the surfaces of said sheet serving to define one of said three insulating air spaces is manufactured to have a low emissivity coefficient.

8. The improved window apparatus of claim 3, wherein said first support members are positioned at spaced intervals on said sheet and extend transverse to said sheet.

9. The improved window apparatus of claim 3, further comprising means for stopping the shade roller as the sheet attains said extended position.

10. The improved window apparatus of claim 1, wherein one of the surfaces of said sheet serving to define one of said three insulating air spaces is manufactured to have a low emissivity coefficient.

* * * * *